US007155752B2

(12) United States Patent
Feda

(10) Patent No.: US 7,155,752 B2
(45) Date of Patent: Jan. 2, 2007

(54) TOILET OVERFLOW CONTROL MECHANISM

(76) Inventor: Brian Feda, 295 Parkview Dr., Aurora, OH (US) 44202

( * ) Notice: Subject to any disclaimer, the term of this patent is extended or adjusted under 35 U.S.C. 154(b) by 402 days.

(21) Appl. No.: 10/877,167

(22) Filed: Jun. 28, 2004

(65) Prior Publication Data

US 2005/0283899 A1 Dec. 29, 2005

(51) Int. Cl.
*E03D 11/02* (2006.01)
*E03D 11/18* (2006.01)

(52) U.S. Cl. ..... 4/427; 4/415

(58) Field of Classification Search ..... 4/324, 4/325, 353, 415, 427, 437
See application file for complete search history.

(56) References Cited

U.S. PATENT DOCUMENTS 2,729,827 A * 1/1956 Morita ..... 4/427
4,402,093 A 9/1983 Luker et al. ..... 4/427
4,633,534 A 1/1987 Hardman ..... 4/412
5,083,323 A 1/1992 Cannan ..... 4/415
5,232,011 A * 8/1993 Royalty ..... 4/427
5,752,281 A * 5/1998 Conner ..... 4/427
6,016,577 A 1/2000 Cooley ..... 4/427

* cited by examiner

*Primary Examiner*—Tuan Nguyen
(74) *Attorney, Agent, or Firm*—Renner, Kenner, Greive, Bobak, Taylor & Weber

(57) ABSTRACT

A control mechanism for preventing overflow of a toilet including a bowl, a water tank, and a filler float operatively communicating with a filler valve includes a knob or handle that can be manipulated to cause the filler float to occupy a position that shuts off the filler valve. The control mechanism includes a filler float guide member having a low guide section separated from a high guide section by a ramped section. By manipulating the knob or handle of the control mechanism, the filler float is forced up the ramp section to the high guide section, shutting off the filler valve.

3 Claims, 4 Drawing Sheets

TOILET OVERFLOW CONTROL MECHANISM

TECHNICAL FIELD

The present invention generally relates to toilet overflow control mechanisms. More particularly, the present invention relates to a toilet overflow control mechanism that can be manipulated to close the refill valve.

BACKGROUND OF THE INVENTION

The elements and operation of a toilet are well known in the art. In FIGS. 1 and 2, two of the most common toilets are shown, a ballcock toilet 100 (FIG. 1) and a floating cup toilet 200 (FIG. 2). In the Figs. and the disclosure that follows, like parts receive like numerals, although differing by 100. In each embodiment, a bowl 102, 202 receives human waste, and a water tank 104, 204, defined by walls 105, 205 holds flush water W capable of initiating a syphon action when released from the water tank 104, 204 into the bowl 102, 202. Although variations exist, these types of toilets 100, 200 are generally flushed by manipulating a flush mechanism 106, 206 that includes a flush handle 108, 208 connected to a lever arm 110, 210 that is connected to a flush valve 112, 212 through a linkage 114 or chain 214. The flush valve 112, 212 seals a drain hole 116, 216 within the water tank 104, 204, and pushing the flush handle 108, 208 causes the flush valve 112, 212 to unseat from the drain hole 110, 210 such that the flush water W enters the toilet bowl 102, 202 from the water tank 104, 204, initiating a syphon so that all of the water and waste in the toilet bowl is flushed.

As the water in the tank 104, 204 drains, a filler float 118, 218 falls with the water level and turns on a filler valve 120, 220 through the operative connection between filler float 118, 218 and filler valve 120, 220. In the embodiment of FIG. 1, the connection is a float lever arm 122 that connects between filler valve 120 and ballcock filler float 118. In the embodiment of FIG. 2, the connection is a push rod 222 that connects between filler valve 220 and sleeve filler float 218. When water tank 104, 204 is filled with flush water W, as shown in FIGS. 1 and 2, filler float 118, 218 occupies a shut-off position, wherein filler valve 120, 220 is closed to the passage of refill water. But filler float 118, 218 rises and falls with the level of flush water W in water tank 104, 204 such that, when flushing mechanism 106, 206 is manipulated to flush bowl 102, 202, the level of flush water W within water tank 104, 204 begins to fall, and filler float 118, 218 falls with it. Once filler float 118, 218 has fallen a short distance with flush water W, it may be considered to occupy a refill position, wherein filler valve 120, 220 allows for the passage of refill water therethrough to refill both bowl 102, 202 and water tank 104, 204. When filler float 118, 218 occupies the refill position, filler valve 120, 220 sends refill water in two directions—into water tank 104, 204 and through overflow tube 124, 224 into bowl 102, 202. It will be appreciated that the refill water filling water tank 104, 204 causes filler float 118, 218 to rise, eventually occupying the shut-off position and closing filler valve 120, 220 to the passage of refill water, ending the refill cycle.

Should a clog in the siphon or bowl occur, water entering bowl 102, 202 will flood the bowl and eventually spill over onto the floor. If the flush valve 112, 212 does not seat properly on drain hole 116, 216 during the tank refill cycle, water entering the tank 104, 204 through filler valve 120, 220 will flow to bowl 102, 202 and will not fill tank 104, 204. Consequently, the filler float 118, 218 will not rise, the filler valve 120, 220 will not be closed, and water will continue to flow to bowl 102, 202 and the floor. Thus, control mechanisms have been proposed for selectively closing the filler valve 120, 220. Although control mechanisms have been addressed in the prior art, as, for example, in U.S. Pat. Nos. 4,402,093, 4,633,534, 5,083,323, and 6,016,577 the present invention provides a very straight forward and user friendly mechanism and method for preventing toilet overflow.

SUMMARY OF THE INVENTION

This invention generally provides a control mechanism for preventing overflow of a toilet that includes a bowl, a water tank, and a filler float operatively communicating with a filler valve. The filler float is movable, by the water level in the water tank, between a refill position, wherein the filler valve allows refill water to flow therethrough to fill the water tank and bowl, and a shut-off position, wherein the filler valve is closed to the flow of water. The control mechanism of this invention comprises means external of the water tank for physically manipulating the filler valve to occupy the shut-off position.

In another embodiment, the present invention provides a toilet comprising a bowl; a water tank holding flush water and having a tank wall; a flush valve communicating between said bowl and said water tank such that opening said flush valve permits flush water from said water tank to flow into said bowl and flush the contents of said bowl; a filler valve in said water tank and controlling the refilling of said bowl and said water tank; a filler float operatively communicating with said filler valve and retained within said water tank and moving with the level of water in said water tank to move between a refill position, wherein said filler valve is open to permit refilling of said water tank, and a shut-off position, wherein said filler valve is closed by the operative communication with said filler float, preventing refilling of said water tank; and an overfill control mechanism including: a knob external of said tank wall of said water tank; a filler float guide member extending from said knob to selectively interact with said filler float within said water tank, said guide member having a ramp section extending between a low guide section and a high guide section, wherein, as said water tank is being refilled, said knob may be manipulated to bring said filler float into contact with said ramp section and further manipulated to urge said filler float up said ramp section to rest on said high guide section in said shut-off position.

BRIEF DESCRIPTION OF DRAWINGS

For a complete understanding of the objects, techniques and structure of the invention, reference should be made to the following detailed description and accompanying drawings wherein.

DETAILED DESCRIPTION OF THE PREFERRED EMBODIMENTS

In the present invention, a control mechanism is provided for preventing the overflow of a toilet, such as, by way of non-limiting example, toilets 100 and 200, generally described above. More particularly, means external of the water tank are provided for physically manipulating the filler float to occupy the shut-off position, closing the filler valve to the flow of refill water. Overflow control mechanisms are shown and described herein for both of the prior art embodiments, but are not to be limited thereto or thereby. Each embodiment is treated separately.

Figure 1:
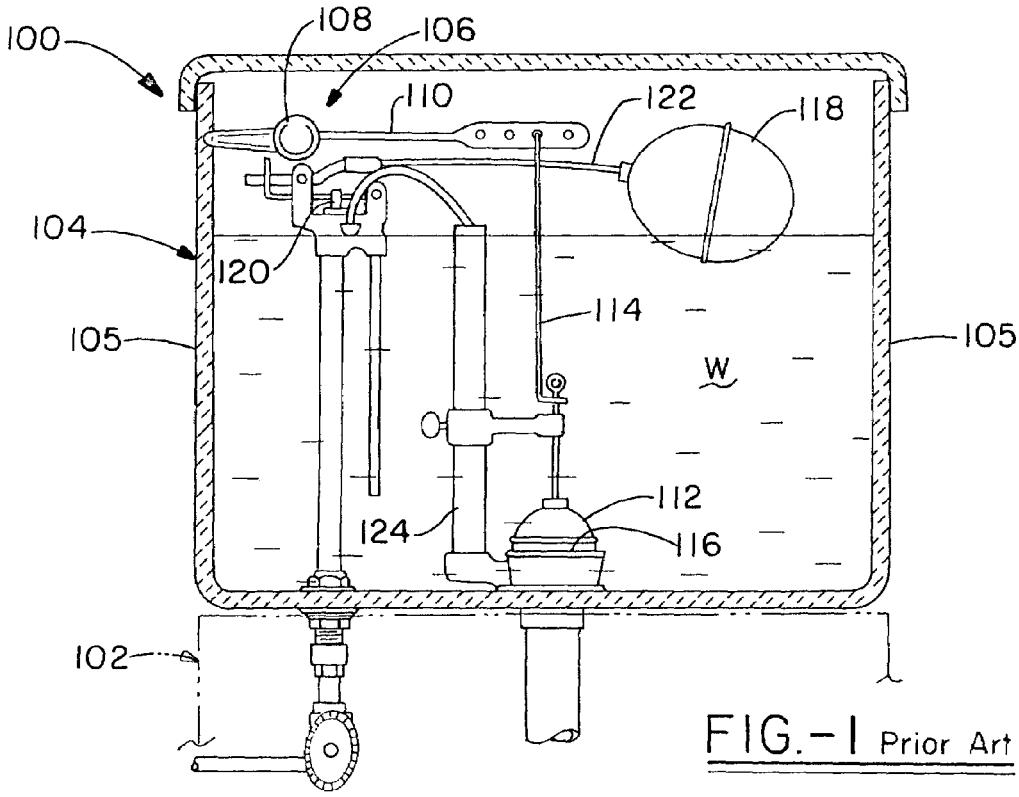
FIG.-1 Prior Art
FIG. 1 is a front elevational view through the front wall of a conventional and known type toilet tank, showing a first configuration for a toilet flush assembly, with the toilet bowl only partially indicated in ghost lines below the tank.
Figure 2:
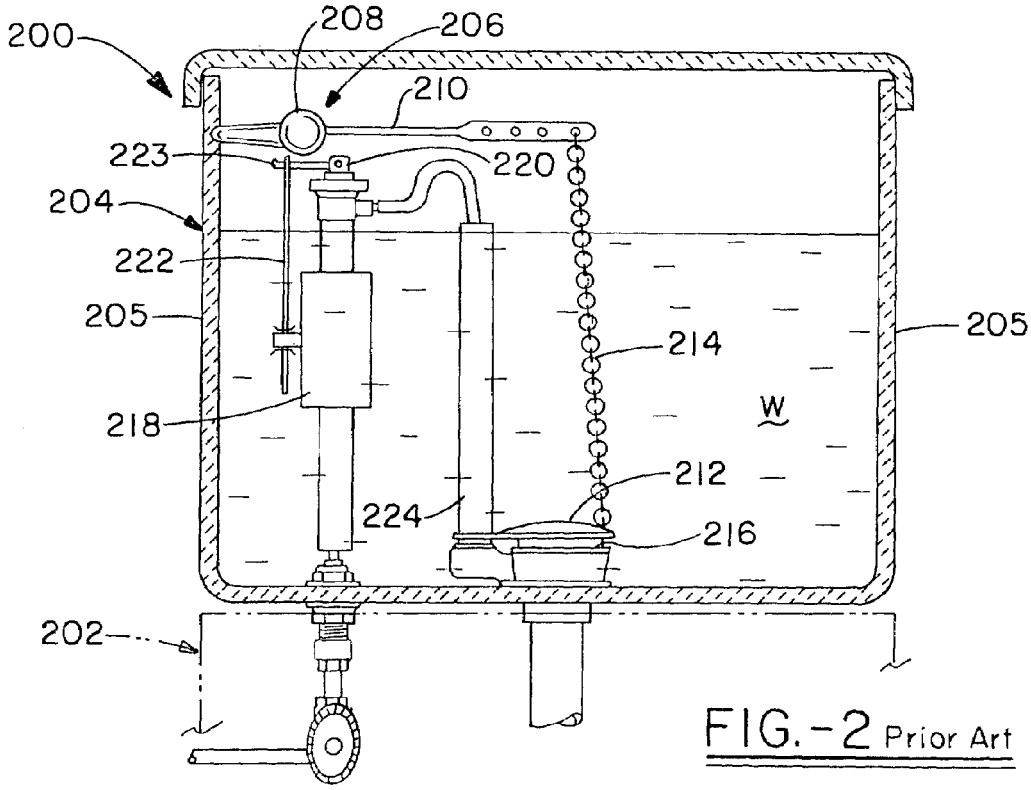
FIG.-2 Prior Art
FIG. 2 is a front elevational view through the front wall of a conventional and known ballcock type toilet tank, showing a second configuration for a toilet flush assembly, with the toilet bowl only partially indicated in ghost lines below the tank.
Figure 3:
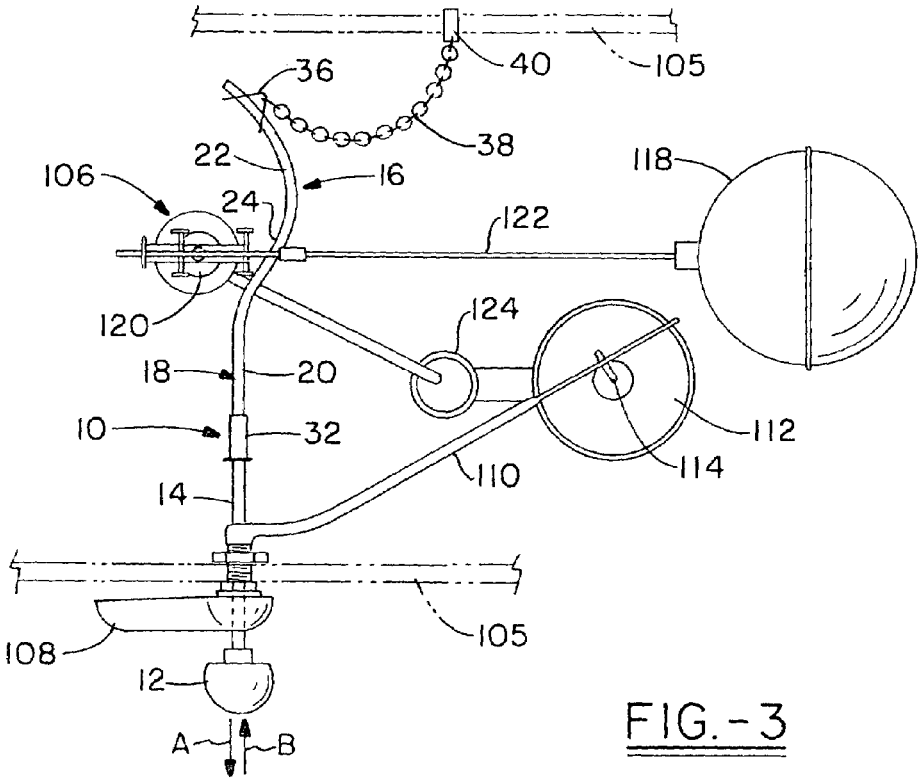
FIG. 3 is a partial top view of the control mechanism of the present invention as it may be applied to the toilet flush assembly shown in FIG. 1.
Figure 4:
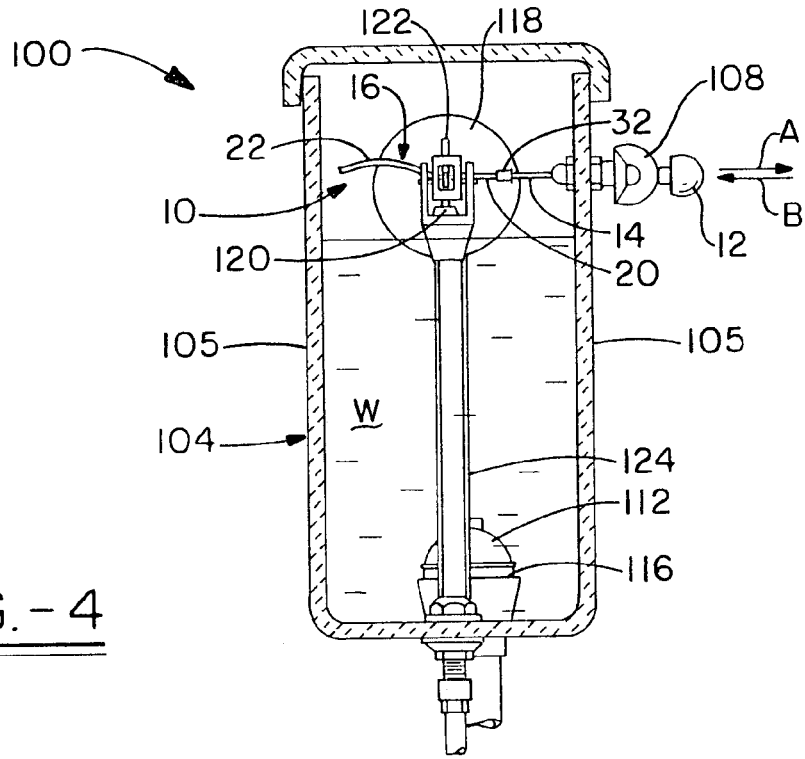
FIG. 4 is a side view through the wall of the toilet, showing the control mechanism as it may be applied to the toilet flush assembly shown in FIG. 1.

In FIGS. 3 and 4, the control mechanism is identified by the numeral 10, and is shown in the ballcock float embodiment of toilet 100 of FIG. 1. In control mechanism 10, knob 12 is provided externally of water tank 104, and connects to shaft 14, which extends to provide an embodiment of a filler float guide member 16. In the particularly preferred embodiment shown, knob 12 is provided at the location of flushing mechanism 106, and extends through handle 108. This allows the control mechanism 10 to be retrofit to an existing prior art toilet 100, as will be described below. It should however be appreciated that control mechanism 100 could be provided elsewhere on water tank 104 and yet still function as desired, and the extension of control mechanism 10 through handle 108 is merely preferred.

Figures 7, 8, 9:
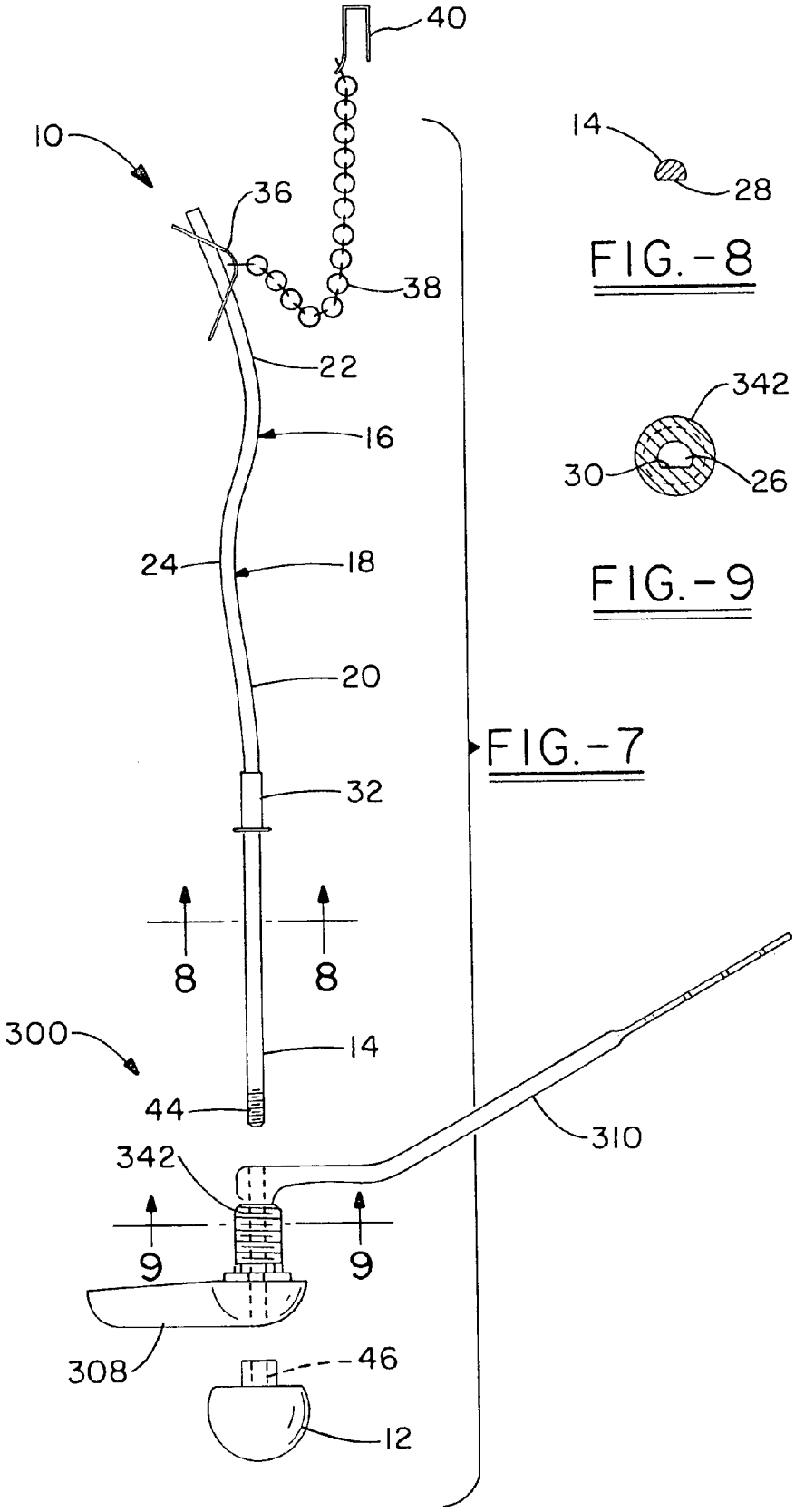
FIG. 7 is an assembly of the parts forming the control mechanism of the present invention, as it may be in a kit form and applied to various known toilet flush assemblies used in the art.
FIG. 8 is a cross-sectional view taken along the line 8—8 of FIG. 7.
FIG. 9 is a cross-sectional view taken along the line 9—9 of FIG. 7.

Filler float guide member 16, in the embodiment of control mechanism 10, includes a malleable or otherwise formable shaft 18 suitably connected to extend from shaft 14. Formable shaft 18 is bent to provide a low guide section 20, which is fixed to shaft 14, for example, by welding. Formable shaft is also bent to provide high guide section 22 separated from low guide section 20 by ramp section 24. As can be seen, the terms "low" and "high" are purposefully chosen to disclose the proper relationship between guide sections 20 and 22. In the views of FIGS. 7–9, it can be seen that shaft 14 cannot rotate within bore 26 formed through some of the elements of flushing mechanism 106, because flat surface 28 on shaft 14 engages flat surface 30 of bore 26. This ensures that low guide section 20 remains "low" and high guide section 22 remains "high."

Shaft 14 and low guide section 20 extend through a tank wall 105 (preferably through a flushing mechanism 106, as shown) to extend below the float lever arm 122 of filler float 118. Enough room is provided between low guide section 20 and float lever arm 122 to permit filler float 118 to fall with the level of water in water tank 104 and move to the refill position. In the event that refilling of water tank 104 and bowl 102 must be stopped, knob 12 may be pulled in the direction of arrow A, forcing filler float 118 up ramp section 24 and onto high guide section 22. High guide section 22 is appropriately positioned such that, when float lever arm 122 rests on high guide section 22, filler float 118 occupies the shut-off position, preventing continued refilling of water tank 104 and bowl 102 through filler valve 120. Stopper 32 is provided on shaft 14 to limit the movement of knob 12. When the overflow problem has been addressed, knob 12 may be pushed in the direction of arrow B to allow filler float 118 to fall back to the refill position, with float lever arm 122 on low guide section 20, allowing tank 104 and bowl 102 to be filled. Then, as normal, filler float 118 may rise with the level of water in water tank 104 to the shut-off position.

As a final note on this embodiment, it might be desirable, due to the leverage of the weight of ballcock filler float 118, to provide an auxiliary support through clip 36 and chain 38. Clip 36 fits on the end of high guide section 22, and chain 38 is selectively fixed thereto and selectively fixed to a mount bracket 40 that clips to the upper edge of a wall 105. By selectively fixing, it is meant that the length of chain 38 between clip 36 and mount bracket 40 may be altered, as desired, to provide a taut support link. Chain 38 provides support to the distal end of control mechanism 10, and prevents formable shaft 18 from bending under the force exerted upon it by float lever arm 122 and ballcock filler float 118.

Figure 5:
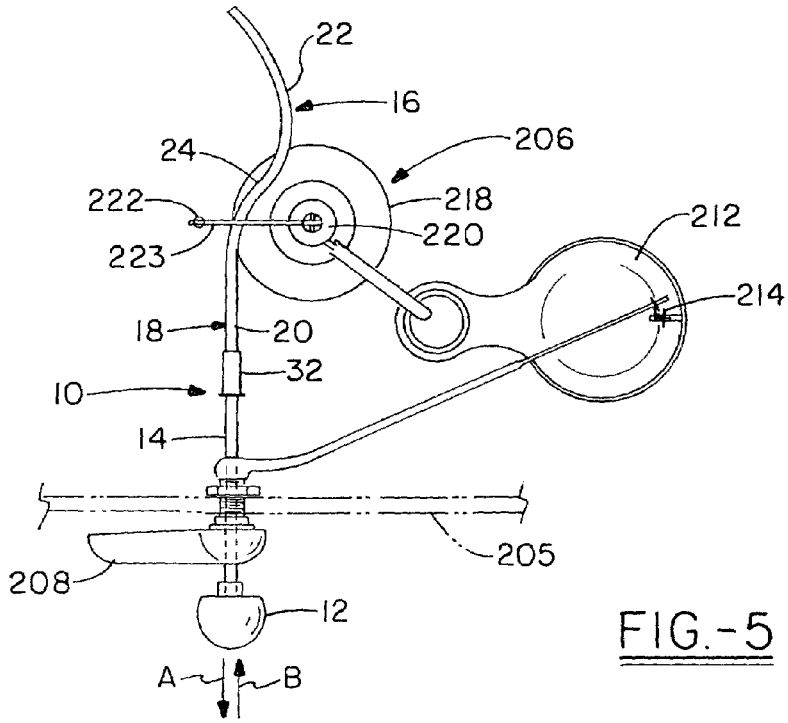
FIG. 5 is a partial top view of the control mechanism of the present invention as it may be applied to the toilet flush assembly shown in FIG. 2.
Figure 6:
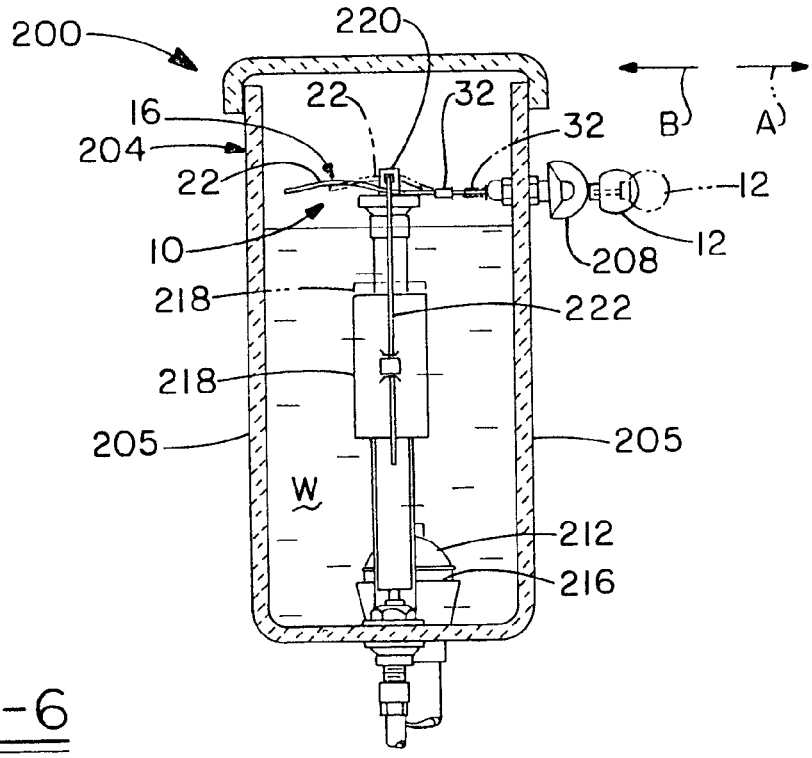
FIG. 6 is a side view through the wall of the toilet, showing the control mechanism as it may be applied to the toilet flush assembly shown in FIG. 2.

A substantially similar embodiment of a control mechanism is shown in FIGS. 5 and 6 as interacting with sleeve filler float 218 of the embodiment of toilet 200. Most elements of the control mechanism for toilet embodiment 200 are similar to control mechanism 10, such that like parts have received like numerals, and it is necessary only to discuss how the control mechanism 10 functions in a toilet like toilet 200. In this environment, control mechanism 10 is configured such that shaft 14 and low guide section 20 extend through a tank wall 205 (preferably through the flushing mechanism 206, as shown) to extend below the a valve lever arm 223 (FIG. 5) of filler valve 220. Enough room is provided between low guide section 20 and valve lever arm 223 to permit filler float 218 to fall with the level of water in water tank 204 and move to the refill position. In the event that the refilling of water tank 204 and bowl 202 must be stopped, knob 12 may be pulled in the direction of arrow A, forcing valve lever arm 223 up ramp section 24 and onto high guide section 22. High guide section 22 is appropriately positioned such that, when valve lever arm 223 rests on high guide section 22, filler float 218 occupies the shut-off position, preventing continued refilling of water tank 204 and bowl 202 through filler valve 220. Stopper 32 is provided on shaft 14 to limit the movement of knob 12. When the overflow problem has been addressed, knob 12 may be pushed in the direction of arrow B to allow filler float 218 to fall back to the refill position, with float lever arm 223 on low guide section 20, allowing tank 204 and bowl 202 to be filled. Then, as normal, filler float 218 may rise with the level of water in water tank 204 to the shut-off position.

With reference to FIGS. 7–9, it should be appreciated that control mechanism 10 may be retrofit to existing toilets. The flush mechanisms, such as mechanisms 106, 206, may be removed, and replaced by a kit 300 providing a knob 12, shaft 14, formable shaft 18, stopper 32, clip 36, and chain 38 of the control mechanism 10 just described. The kit 300 further includes a flush handle 308, with a bore 26 extending through a threaded section 342 and having a flat surface 30 to interact with the flat surface 28 of shaft 14. Lever arm 310 is provided extending from threaded section 342. Threads 44 on shaft 14 engage threads 46 in knob 12. The old flush mechanism is removed and replaced by kit 300. It should now be appreciated that formable shaft 18 is formable so that it may be shaped to provide an appropriate low guide section 20, ramp section 24, and high guide section 22 that allow the filler valve mechanism of the toilet to operate normally, and yet, when necessary, provide means for shutting off the flow of refill water, as already described fully above with respect to the embodiments and disclosures of control mechanism 10.

Thus it can be seen that the present invention provides improvements in overflow control mechanisms and methods for toilets. While in accordance with the patent statutes only the best mode and preferred embodiment of the invention has been presented and described in detail, the invention is not limited thereto or thereby. Accordingly, for an appreciation of the scope and breadth of the invention reference should be made to the following claims.

What is claimed is:

1. A toilet comprising:

a bowl;

a water tank holding flush water and having a tank wall;

a flush valve communicating between said bowl and said water tank such that opening said flush valve permits flush water from said water tank to flow into said bowl and flush the contents of said bowl;

a filler valve in said water tank and controlling the refilling of said bowl and said water tank;

a filler float operatively communicating with said filler valve and retained within said water tank and moving with the level of water in said water tank to move between a refill position, wherein said filler valve is open to permit refilling of said water tank, and a shut-off position, wherein said filler valve is closed by the operative communication with said filler float, preventing refilling of said water tank; and an overfill control mechanism including:

a knob external of said tank wall of said water tank;

a filler float guide member extending from said knob to selectively interact with said filler float within said water tank, said filler float guide member having a ramp section extending between a low guide section and a high guide section, wherein, as said water tank is being refilled, said knob is manipulated to bring said filler float into contact with said ramp section and further manipulated to urge said filler float up said ramp section to rest on said high guide section in said shut-off position.

2. A control mechanism as in claim 1, wherein said filler float guide member is formable to provide the low guide section separated from the high guide section by the ramp section.

3. A toilet as in claim 1, wherein said filler float guide member connects to said knob through a flush handle of the toilet.

* * * * *